US006726876B1

(12) United States Patent
Staker

(10) Patent No.: US 6,726,876 B1
(45) Date of Patent: Apr. 27, 2004

(54) STAKALLOY: A URANIUM-VANADIUM-NIOBIUM ALLOY

(75) Inventor: Michael R. Staker, Churchville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/329,396

(22) Filed: Dec. 27, 2002

(51) Int. Cl.[7] ..... C22C 43/00
(52) U.S. Cl. ..... 420/3; 148/401; 148/560
(58) Field of Search ..... 420/3; 148/401, 148/560

(56) References Cited

U.S. PATENT DOCUMENTS 2,990,274 A * 6/1961 Greenberg ..... 420/3
3,969,160 A 7/1976 Hemperly
3,981,722 A * 9/1976 Ray et al. ..... 148/401
4,935,200 A 6/1990 LaSalle
4,968,482 A * 11/1990 Ludtka et al. ..... 420/3
5,963,777 A 10/1999 Staker

OTHER PUBLICATIONS

M.R. Staker, "The U–V Equilibrium Phase Diagram", J. of Alloys & Compounds 266 (1998) pp. 167–179.
J.F. Smith, "Uranium–Vanadium", J. of Phase Equilibria vol. 19 , No. 6 (1998) pp. 603–604.
H. Okamoto, Desk Handbook, Phase Diagrams for Binary Alloys, ASM International (2000).

* cited by examiner

*Primary Examiner*—Ngoclan T. Mai
(74) *Attorney, Agent, or Firm*—William W. Randolph

(57) ABSTRACT

A ternary alloy of uranium, referred to as stakalloy, having improved machinability is formed of niobium, vanadium and uranium. The ternary alloy is formed with the percent by weight of vanadium being between the gamma eutectoid (1.0 percent by weight vanadium) and the eutectic (4.5 percent by weight vanadium) compositions, and the niobium content being between 0.01 to 0.95 percent by weight and the balance being uranium. Stakalloy has different density, improved metallurgical properties, such as different hardness, machinability, and ballistic properties from other uranium alloys, making it useful as a structural alloy where high density and high strength are important.

20 Claims, 1 Drawing Sheet

STAKALLOY: A URANIUM-VANADIUM-NIOBIUM ALLOY

The invention described herein may be manufactured, used and licensed by or for the U.S. Government without the payment of any royalty thereon.

FIELD OF THE INVENTION

The present invention generally relates to alloys of uranium, and, more particularly to ternary alloys of uranium, vanadium and niobium.

DESCRIPTION OF THE PRIOR ART

Binary alloys of uranium and vanadium are described in U.S. Pat. No. 5,963,777 issued to Michael Staker and which is incorporated by reference herein. U.S. Pat. No. 5,963,777 describes the making and usefulness of the alloys; whereas, the science of the alloys system is described in a journal article by M. R. Staker, J. Alloys and Compounds 266, 167 (1998). Distinctions between binary alloys of U.S. Pat. No. 5,963,777, consisting essentially of pure vanadium and uranium, and earlier alloys of uranium and vanadium from the 1950's, which had greater carbon contents, are described in the journal article. This difference between essentially pure uranium-vanadium binary alloys and the uranium-vanadium-carbon ternary alloys is discussed in the review of the new uranium-vanadium phase diagram by J. F. Smith in J. Phase Equilibria 19, No. 6, 603 (1998) and in another publication, a book, "Desk Handbook: Phase Diagrams for Binary Alloys" edited by H. Okamoto, an ASM Publication (2000) on page 773. In both publications, the corrections to the phase diagram are carefully considered. Carbon, in older alloys, was in the range of 100 to 1000 weight parts per million (Wppm) and was an unintentional alloying contaminate that caused the old binary phase diagram to be in error. Before this discovery, ternary alloys of uranium-vanadium-carbon were mistakenly thought to be binary alloys of uranium-vanadium. The new phase diagram research has shown carbon to be a significant alloying ingredient and has set limits on the amount of carbon allowed (as a contaminate) in order for the alloy to behave as a simple binary alloy, generally about 100 Wppm. The new phase diagram has also allowed the true uranium-vanadium binary alloys system (without large percentages of carbon) to be utilized and exploited. In alloys of uranium-vanadium where the carbon level is above 100 weight parts per million (Wppm) the carbon acts as a major alloying element, resulting in a uranium-vanadium-carbon ternary alloy, and affecting the phase diagram and most other metallurgical properties.

Other uranium alloys include either binary alloys of uranium, with elements other than vanadium; or polynary alloys, that contain other elements, as main alloying elements. Examples include uranium-titanium, uranium molybdenum, uranium-titanium-hafnium (such as in LaSalle et al, U.S. Pat. No. 4,935,200), and uranium-titanium-vanadium (such as in Hemperly, U.S. Pat. No. 3,969,160). These suggest a general trend of increasing hardness and strength as additional elements are added to the alloys. General principles of metallurgy and examples taken from these polynary uranium alloys suggests that the addition of further alloying elements increases the hardness and decreases the machinablity of the alloys as additional elements are added. For some purposes it may be desirable to utilize uranium alloys with improved machinability properties.

BRIEF SUMMARY OF THE INVENTION

The invention is a family of alloys of uranium, vanadium and niobium or a composition of matter hereafter also known as stakalloy having compositions in the ranges comprising 1.0 to 4.5 percent by weight vanadium, 0.01 to 0.95 percent by weight niobium, and the balance being uranium. These alloys may be solutionized and quenched. They may also be aged.

DETAILED DESCRIPTION OF THE INVENTION

Figure 1:
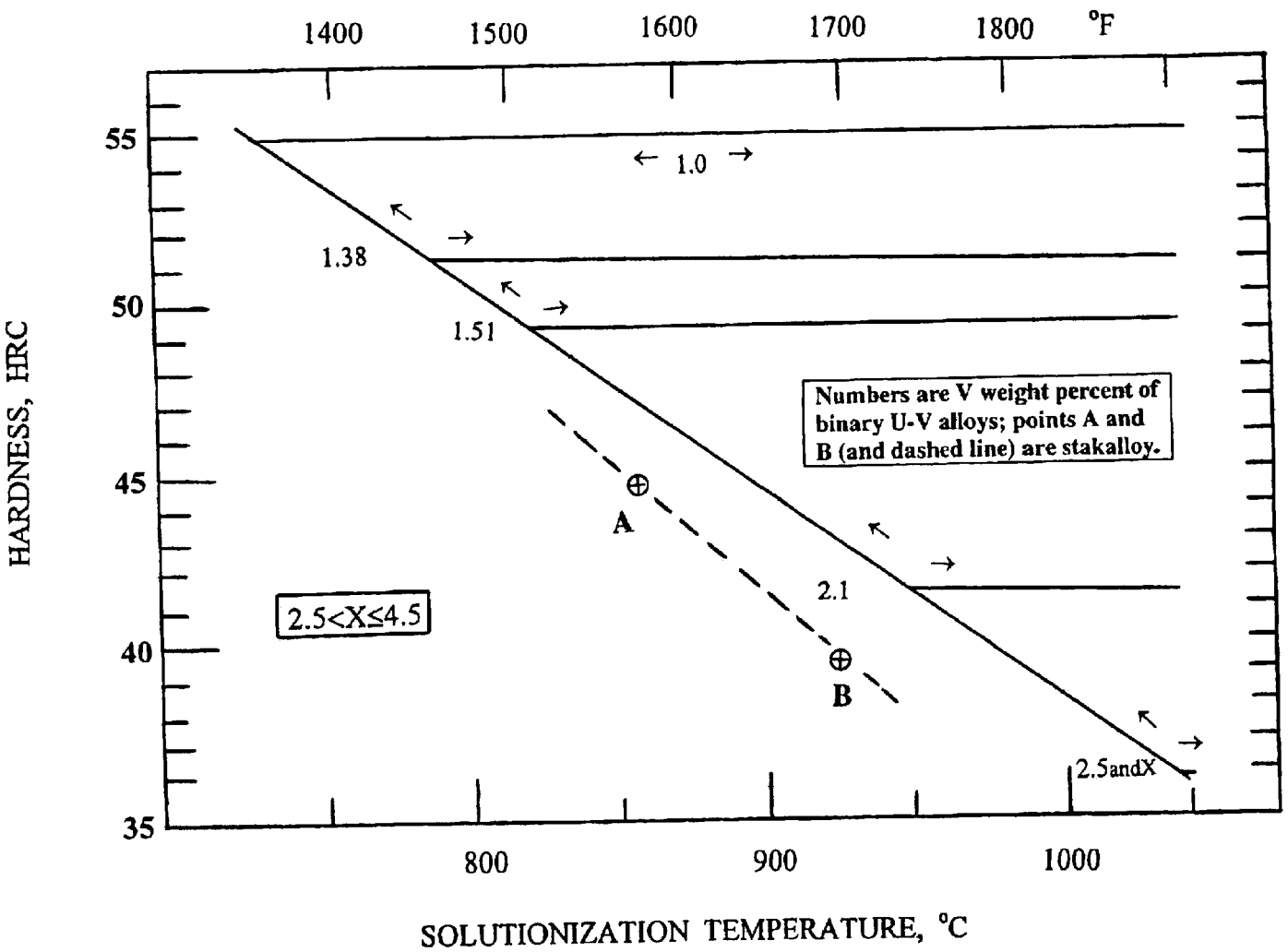
FIG. 1 shows graphs of hardness as a function of solutionization temperature for both the uranium-vanadium binary alloys, represented in solid lines, and the uranium-vanadium-niobium ternary alloy, also called stakalloy, represented in the dashed line.

The ternary alloys of uranium-vanadium-niobium of the present invention are made by adding together uranium with selective amounts of vanadium and niobium while sufficiently excluding excessive carbon levels. The resulting ternary alloys having specific ranges of constituents of uranium, vanadium and niobium are hereafter also referred to as stakalloy. Many of the advantages of the binary uranium-vanadium alloy system can be retained and improved upon by the addition of niobium to the binary family of uranium-vanadium alloy system. The family of binary uranium-vanadium alloys of interest used in making these ternary alloys preferably include those where the vanadium comprises from about 1.0 to about 4.5 percent by weight, those that lie between the gamma eutectoid composition (1.0 percent by weight vanadium) and the eutectic composition (4.5 percent by weight vanadium). Metallurgical advantages resulting from the addition of niobium to the binary uranium-vanadium alloy system include changes in hardness, density, phase transformation rates, mechanical properties, ballistic properties, and, importantly, machinability. Because niobium is less dense than uranium, addition of niobium in amounts of 0.01 to about 0.95 percent by weight to a binary alloy of uranium-vanadium in the composition range of 1.0 to 4.5 percent by weight of vanadium will result in a lower density for the ternary alloy compared to the binary alloy. Because of the solubility of niobium in uranium at elevated temperatures, it can be dissolved as a substitute solid solution element in the uranium crystal structure, and in this sense behaves like vanadium in that they both are soluble as substitional elements in the uranium crystal structure. Prior to the making of these alloys, it would be difficult to predict what stakalloy would be like; however, it is significantly different from other alloys.

Ternary alloys of uranium, vanadium, and niobium may be produced by different methods. One approach is to melt together the three element in the manner of Staker (U.S. Pat. No. 5,963,777), with the important exception that the element niobium is prepared, in addition to vanadium, to be charged into the melt or placed with melt stock before heat-up (along with the vanadium and uranium melt stock). One suitable uranium melt stock that is generally very low in carbon if cleaned properly is derby, which is depleted uranium and is sometimes referred to by its Manhattan Project code name, tuballoy; distinguishing it from enriched uranium, also referred to as oralloy. Preferably, layers of each element are alternated during charging the melt stock for induction melting to aid in the melting, mixing and homogeneity of the final castings; although this is not a necessary requirement. Another melting technique is arc melting. This invention is not limited to the method of melting, but applies to any melting technique including bottom pour or top pour from a crucible in which the niobium is added to the alloy to end up with any ternary alloy within a family of alloys of uranium-vanadium-niobium which is a composition of matter comprising 1.0 to 4.5 percent by weight vanadium and 0.01 to 0.95 percent by weight niobium with the balance being uranium or depleted uranium. This family of ternary alloys with these composition ranges is also referred to as stakalloy, and any alloy within these composition ranges is also referred to and called stakalloy.

Various other elements may also be present in small quantities without adversely affecting the mechanical properties of these alloys, and thus the alloys with these elements in them in trace quantities would be included within this invention. Some of the elements that could be inadvertently included are: Mo, Sc, Ti, Zr, Hf, Al, Cu, Cr, Fe, Mn, Ni, Si, Mg, Ca, Co, Zn, Sr, Y, La, Ta, and W.

As described in U.S. Pat. No. 5,963,777 and in J. Alloys and Compounds 266, 167 (1998), hydrogen and carbon are elements which may result from processing steps and which may be detrimental or adversely affect the physical properties of the binary alloy if certain levels in weight parts per million (Wppm) are exceeded. Generally, hydrogen levels above 5 parts per million and carbon levels above 100 parts per million for alloys containing uranium and vanadium have been found to be detrimental. For example, if the carbon level is higher than this value, carbides may form and degrade the properties of the alloys containing uranium and vanadium. The same is also true of stakalloy. The presence of hydrogen and carbon may be minimized by proper processing techniques such as vacuum melting, vacuum or inert atmosphere solutionizing and heat treating, and the use of proper crucibles and molds which minimize carbon pick-up. In general, uncoated graphite molds and crucibles should not be used. In addition, the surfaces of derby melt stock should be cleaned or machined away so as to remove surface contamination that may include high levels of impurities, including carbon.

After casting the ingot, the alloy can be used in the as-cast condition or be hot or cold worked to change its shape and metallurgical properties; and then used in that condition. It may also be used in the heat-treated condition after the shape change caused by hot or cold working. These heat treatments may be of a variety of types. One of these would be to solutionize the vanadium and niobium in the gamma or in the gamma plus delta phase fields between about 727° C. and about 1040° C. and then cool the alloy at a controlled rate of cooling. Usually the cooling rate is controlled by using a liquid bath quench, but the cooling rate can be any cooling rate. Water is an example of a liquid quench media that works very well. After solutionizing (an example of a heat-treatment) and quenching, the alloy may then be aged or be used unaged. Aging consists of reheating the alloy to a temperature above room temperature but below the solutionization temperature and below the alpha to beta transition temperature of about 652° C. and holding the alloy at that temperature for a specified amount of time.

Having generally set forth the family of ternary alloys and method of production of these alloys, the following examples are presented to illustrate preferred operable modes of carrying out the invention. While the examples demonstrate specific compositions within the family of ternary alloys, the full ranges of compositions described above are contemplated.

Example number I of stakalloy was made by charging vanadium, niobium and depleted uranium melt stock into a vacuum furnace and heating with induction coils until all three elements were liquid, thereby forming the alloy; as all three elements are soluble in the molten state. The molten alloy, having about 2 percent by weight vanadium and about 0.25 percent by weight niobium and the balance being depleted uranium, was cast into a mold and cooled. Chemistry checks after solidification showed the vanadium content to be 1.99 weight percent, the niobium to be 0.22 weight percent, and the carbon to be 82 Wppm. After de-rizering the ingot by cutting off the top riser, it was homogenized at a temperature of about 900° C. for 60 hours. Then it was hot rolled at temperatures near but below 650° C. After cooling it was reheated to 860° C. for 1 hour (solutionized) and water quenched. At this point, it can be used as is or machined to final shape for use as a structural material. The ternary alloy had a hardness of 44.9 HRC. Without the addition of niobium, but using the exact same processing conditions, a binary alloy of uranium-vanadium was produced for comparison and had a hardness of 47.4 HRC, a significantly different hardness. Both of these alloys had the banded martensitic alpha prime microstructure typical of uranium alloys above 1.5 percent by weight of vanadium. This addition of niobium provided an alloy with significantly different metallurgical properties, such as lower density, unexpected decreased hardness and the related improved machinability.

In example number II of stakalloy, which had the same processing conditions as above except for using a solutionization temperature of 927° C., instead of 860° C., the hardness for the ternary alloy (stakalloy) was 39.4 HRC and the binary alloy (uranium-vanadium only), which. was made for comparison in exactly the same way, had a hardness of 43.7 HRC, again a significantly different hardness. These lower hardnesses improve the machinability of stakalloy. These differences in metallurgical properties between binary alloys of uranium-vanadium and stakalloy were unexpected and are due to the difference in composition.

These differences can be visualized by observing FIG. 1, where the hardness is shown as a function of solutionization temperature for both stakalloy from the above two examples, along with the hardness of the family of binary alloys of uranium-vanadium (see U.S. Pat. No. 5,963,777). In FIG. 1 the uranium-vanadium binary alloys are represented in solid lines, and the uranium-vanadium-niobium ternary alloy, also called stakalloy, is represented in the dashed line. Each solid line of the binary alloys starts at the right side of the horizontal portion (near 1040° C.), proceeds horizontally to the left until they intersect the uphill and common portion of the curve where they continue until they end at the left and top point at 730° C. and 55 HRC, which is shared by the entire family of binary alloys. The fact that both points A and B for the ternary alloy (from examples I and II above) are below the lines for the binary alloys demonstrate this difference (and additionally, it is indicated by the dashed line through points A and B). The unexpected reduction in hardness between stakalloy and binary uranium-vanadium alloys provides for improved machinability. The higher hardness values at all the solutionization temperatures (when compared to the above two examples and those with solutionization temperatures in between these, as in the dashed line), that is, the hardness versus solutionization temperature curve would be significantly higher for the binary alloys with resulting increased diffi culty in machining. Because of these differences in composition, hardness, and machinability, stakalloy is not similar to alloys in the family of binary uranium-vanadium alloys. Similar properties are normally presumed when alloys are close in structure, but it did not happen in the comparisons made, two examples of which are given above. In general, general principles of metallurgy and examples taken from polynary uranium alloys suggest that the addition of further alloying elements increases the hardness and decreases the machinablity of the alloys. The experimental findings suggest the degree of predictability from one uranium alloy to another is low. As indicated above, the addition of niobium to an alloy of uranium and vanadium unexpectedly resulted in a lowering of the hardness and thus improved machinability. The examples given above are illustrative of compositions of matter, called stakalloy, and demonstrate specific compositions within the alloy family of stakalloy, where vanadium is from about 1.0 to about 4.5 percent by weight, niobium is from about 0.01 to about 0.95 percent by weight, and the balance is uranium.

Stakalloy is useful for structural members, such as kinetic energy penetrators. In using stakalloy for this application, the task is to defeat armor, that is, to stab, impale or stake the armor.

Having described for purposes of illustration the invention in detail, it will be understood that various changes and modifications may suggest themselves to one skilled in the art, all falling within the scope of the invention as defined by the attached claims.

Having described my invention, I claim:

1. A composition of matter called stakalloy which is a uranium alloy, comprising:

about 1.0 to about 4.5 percent by weight vanadium;

about 0.01 to about 0.95 percent by weight niobium;

and, the balance uranium.

2. A composition of matter as in claim 1, comprising:

0.05 to 0.95 percent by weight niobium.

3. A composition of matter as in claim 1, comprising:

0.10 to 0.90 percent by weight niobium.

4. A composition of matter as in claim 1, comprising:

0.01 to 0.5 percent by weight niobium.

5. A composition of matter as in claim 1, comprising:

0.05 to 0.50 percent by weight niobium.

6. A composition of matter as in claim 1, comprising:

0.1 to 0.5 percent by weight niobium.

7. A composition of matter as in claim 1, comprising:

about 0.25 percent by weight niobium.

8. A composition of matter called stakalloy which is a uranium alloy, consisting essentially of:

1.0 to 4.5 percent by weight vanadium;

0.01 to 0.95 percent by weight niobium;

and, the balance uranium.

9. A composition of matter as in claim 8, consisting essentially of:

0.05 to 0.95 percent by weight niobium.

10. A composition of matter as in claim 8, consisting essentially of:

0.10 to 0.90 percent by weight niobium.

11. A composition of matter as in claim 8, consisting essentially of:

0.01 to 0.5 percent by weight niobium.

12. A composition of matter as in claim 8, consisting essentially of:

0.05 to 0.50 percent by weight niobium.

13. A composition of matter as in claim 8, consisting essentially of:

0.1 to 0.5 percent by weight niobium.

14. A composition of matter as in claim 8, consisting essentially of:

about 0.25 percent by weight niobium.

15. The composition of matter as in claim 1, wherein the alloy has been solutionized in the temperature range 727 to 1040° C. and quenched.

16. The composition of matter as in claim 8, wherein the alloy has been solutionized in the temperature range 727 to 1040° C. and quenched.

17. The composition of matter as in claim 1, wherein the alloy has been solutionized in the temperature range 727 to 1040° C. and quenched and aged.

18. The composition of matter as in claim 8, wherein the alloy has been solutionized in the temperature range 727 to 1040° C. and quenched and aged.

19. The composition of matter as in claim 5, wherein the alloy has been solutionized in the temperature range 727 to 1040° C. and quenched.

20. The composition of matter as in claim 12, wherein the alloy has been solutionized in the temperature range 727 to 1040° C. and quenched.

* * * * *